US010460670B2

(12) United States Patent
Maeda

(10) Patent No.: US 10,460,670 B2
(45) Date of Patent: Oct. 29, 2019

(54) DISPLAY DEVICE AND METHOD FOR CONTROLLING THE SAME

(71) Applicant: JOLED INC., Tokyo (JP)

(72) Inventor: Tomoyuki Maeda, Tokyo (JP)

(73) Assignee: JOLED INC., Tokyo (JP)

( * ) Notice: Subject to any disclaimer, the term of this patent is extended or adjusted under 35 U.S.C. 154(b) by 74 days.

(21) Appl. No.: 15/407,605

(22) Filed: Jan. 17, 2017

(65) Prior Publication Data

US 2017/0206841 A1 Jul. 20, 2017

(30) Foreign Application Priority Data

Jan. 19, 2016 (JP) ..... 2016-008238

(51) Int. Cl.

| | |
|---|---|
| ***G09G 3/3266*** | (2016.01) |
| ***G09G 3/20*** | (2006.01) |
| ***G09G 3/3291*** | (2016.01) |
| ***G09G 3/3233*** | (2016.01) |

(52) U.S. Cl.

CPC ..... *G09G 3/3266* (2013.01); *G09G 3/2018* (2013.01); *G09G 3/3233* (2013.01); *G09G 3/3291* (2013.01); *G09G 2300/043* (2013.01); *G09G 2300/0819* (2013.01); *G09G 2300/0842* (2013.01); *G09G 2310/0251* (2013.01); *G09G 2310/08* (2013.01)

(58) Field of Classification Search

CPC .. G09G 3/3225; G09G 3/3233; G09G 3/3258; G09G 3/3266; G09G 3/3291; G09G 3/2018; G09G 2310/08; G09G 2300/043

USPC ..... 345/76–83

See application file for complete search history.

(56) References Cited

U.S. PATENT DOCUMENTS 5,257,350 A * 10/1993 Howard ..... G09G 1/16 327/141
2004/0183945 A1* 9/2004 Ochiai ..... G09G 5/395 348/441
2010/0156866 A1* 6/2010 Yeo ..... G09G 3/3406 345/208
2010/0309186 A1* 12/2010 Minami ..... G09G 3/3233 345/211
2011/0128276 A1* 6/2011 Toyomura ..... G09G 3/3233 345/212

(Continued)

FOREIGN PATENT DOCUMENTS

JP 2009-047818 3/2009

*Primary Examiner* — Jimmy H Nguyen

(74) *Attorney, Agent, or Firm* — Greenblum & Bernstein, P.L.C.

(57) ABSTRACT

A display device is provided that includes a plurality of pixels, each of which includes an electroluminescent (EL) element and a drive transistor that controls a current flowing through the EL element. The display device also includes a gate driver circuit that applies, to each of the plurality of pixels, a compensation voltage for compensating a threshold voltage of the drive transistor, in each of compensation voltage application periods included in a period other than a period in which a video signal voltage is applied. The display device further includes a control circuit that controls the gate driver circuit, wherein the control circuit adjusts a length of, among the compensation voltage application periods, a preceding compensation voltage application period immediately before the video signal voltage is applied.

4 Claims, 8 Drawing Sheets

(56) References Cited

U.S. PATENT DOCUMENTS

2011/0176080 A1* 7/2011 Toyooka ..... G09G 3/3651
349/41

* cited by examiner

DISPLAY DEVICE AND METHOD FOR CONTROLLING THE SAME

CROSS REFERENCE TO RELATED APPLICATION

The present application is based on and claims priority of Japanese Patent Application No. 2016-008238 filed on Jan. 19, 2016. The entire disclosure of the above-identified application, including the specification, drawings and claims is incorporated herein by reference in its entirety.

FIELD

The present disclosure relates to display devices and in particular to a display device including pixels each of which includes an EL (electroluminescent) element and a drive transistor which controls a current flowing through the EL element, and a method for controlling the display device.

BACKGROUND in recent years, a display device using organic EL is drawing attention as one of next-generation flat panel displays as a substitute for liquid crystal display devices. Active-matrix display devices such as display devices using organic EL include thin-film transistors (TFTs) as drive transistors in respective pixels of the display devices.

In a drive transistor including a TFT, a threshold voltage shifts due to voltage stress such as a gate-source voltage when a current is applied. In addition, a shift amount of the threshold voltage differs from pixel to pixel included in a display device. The shift of the threshold voltage causes a variation in an amount of current supplied to an organic EL element. Thus, this may affect luminance control of the display device, and degrade display quality.

A technique is known which, in order to compensate a threshold voltage of a drive transistor, applies to the drive transistor a compensation voltage for compensating the threshold voltage, in a period other than a period in which a video signal voltage is applied to the drive transistor (for example, Patent Literature (PTL) 1).

CITATION LIST

Patent Literature

[PTL 1]
Japanese Unexamined Patent Application Publication No. 2009-47818

SUMMARY

Technical Problem

The display device disclosed by PTL 1 applies a compensation voltage multiple times to further ensure compensation for a threshold voltage.

However, with a threshold voltage compensation method disclosed by PTL 1, compensation for a threshold voltage continues in a period in which a compensation voltage is not applied, and thus a degree of the compensation for the threshold voltage varies according to the length of the period in which the compensation voltage is not applied. In other words, the degree of the compensation varies according to the length of a period from when a compensation voltage is applied to a drive transistor to when a video signal voltage is applied, and thus luminance of a display device may vary according to the degree of the compensation for the threshold voltage.

The present disclosure has been conceived in view of the above problem, and an object of the present disclosure is to provide a display device capable of reducing a variation in a degree of compensation for a threshold voltage in a drive transistor, and a method for controlling the display device.

Solution to Problem

In order to achieve the above object, a display device according to an aspect of the present disclosure includes: a plurality of pixels each of which includes an electroluminescent (EL) element and a drive transistor which controls a current flowing through the EL element; a gate driver circuit which applies, to each of the plurality of pixels, a compensation voltage for compensating a threshold voltage of the drive transistor, in each of compensation voltage application periods included in a period other than a period in which a video signal voltage is applied; and a control circuit which controls the gate driver circuit, wherein the control circuit adjusts a length of, among the compensation voltage application periods, a preceding compensation voltage application period immediately before the video signal voltage is applied.

Moreover, in order to achieve the above object, a method for controlling a display device according to an aspect of the present disclosure is a method for controlling a display device including a plurality of pixels each of which includes an EL element and a drive transistor which controls a current flowing through the EL element, the method including: applying, to each of the plurality of pixels, a compensation voltage for compensating a threshold voltage of the drive transistor, in each of compensation voltage application periods included in a period other than a period in which a video signal voltage is applied; and adjusting a length of, among the compensation voltage application periods, a preceding compensation voltage application period immediately before the video signal voltage is applied.

Advantageous Effects

The present disclosure can provide a display device capable of reducing a variation in a degree of compensation for a threshold voltage in a drive transistor, and a method for controlling the display device.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENTS

Hereinafter, embodiments of the present disclosure will be described with reference to the drawings. It is to be noted that the embodiments described below each show a specific example of the present disclosure. The numerical values, shapes, materials, structural components, the arrangement and connection of the structural components, steps, order of the steps, etc. indicated in the following embodiments are mere examples, and therefore are not intended to limit the present disclosure. Therefore, among the structural components in the following embodiments, components not recited in any of the independent claims which indicate the broadest concepts of the present disclosure are described as arbitrary structural components.

It is to be noted that the respective figures are schematic diagrams and are not necessarily precise illustration. Additionally, in the respective figures, substantially identical components are assigned the same reference signs, and overlapping description is omitted or simplified.

Embodiment (Entire Configuration of Display Device)

First, an entire configuration of a display device according to an embodiment will be described with reference to the drawings.

Figure 1:
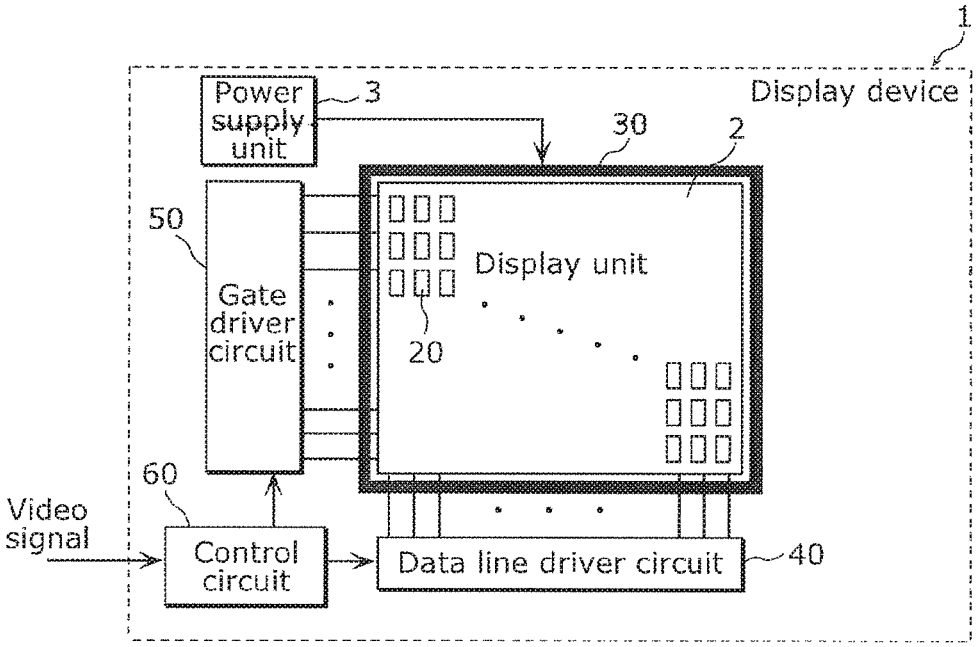
FIG. 1 is a functional block diagram illustrating an entire configuration of a display device according to an embodiment.

FIG. 1 is a functional block diagram illustrating the entire configuration of a display device 1 according to the embodiment.

The display device 1 according to the embodiment includes a display unit 2, a power supply unit 3, a data line driver circuit 40, a gate driver circuit 50, and a control circuit 60.

The display unit 2 is a display panel on which pixels 20 each of which includes an organic EL element and a circuit element for driving the organic EL element to emit light are arranged in a matrix.

The power supply unit 3 feeds a power supply voltage to each pixel 20 via a power feeding line 30 disposed in an outer circumference area of the display unit 2. It is to be noted that the power feeding line 30 includes a positive voltage feeding line which transmits a positive power supply voltage, and a negative voltage feeding line which transmits a negative power supply voltage having a lower potential than the positive power supply voltage.

The control circuit 60 controls the data line driver circuit 40 and the gate driver circuit 50. The control circuit 60 generates a gradation signal corresponding to luminance of each organic EL element, based on a video signal inputted from the outside, and outputs the generated gradation signal to the data line driver circuit 40. In the embodiment, the control circuit 60 outputs to the data line driver circuit 40 a signal indicating a magnitude of a compensation voltage for compensating a threshold voltage of the drive transistor included in each pixel 20.

Moreover, the control circuit 60 generates a control signal for controlling the gate driver circuit 50, based on a synchronization signal to be inputted, and outputs the generated control signal to the gate driver circuit 50. In the embodiment, the control circuit 60 outputs to the gate driver circuit 50 a signal for controlling a timing and a period with and in which a compensation voltage for compensating a threshold voltage of the drive transistor included in each pixel 20 is applied. Specifically, the control circuit 60 includes a CPU and a timing controller. In the control circuit 60, the CPU controls the timing controller based on an inputted synchronization signal, to cause the timing controller to Output the control signal to the data line driver circuit 40 and the gate driver circuit 50. The operation of the control circuit 60 will be described in detail below.

The data line driver circuit 40 drives data lines of the display unit 2 based on the gradation signal generated by the control circuit 60. More specifically, the data line driver circuit 40 outputs to each pixel circuit a video signal voltage (data voltage) reflecting a video signal, based on the video signal and a horizontal synchronization signal. In the embodiment, the data line driver circuit 40 also outputs a compensation voltage for compensating a threshold voltage of the drive transistor included in each pixel 20.

The gate driver circuit 50 drives scan lines etc. of the display unit 2 based on the control signal generated by the control circuit 60. More specifically, the gate driver circuit 50 outputs a scan signal etc. to each pixel circuit on at least a display line unit basis, based on a vertical synchronization signal and a horizontal synchronization signal. In the embodiment, the gate driver circuit 50 drives the scan lines to apply to each pixel 20 the compensation voltage for compensating the threshold voltage of the drive transistor included in each pixel 20, in each of compensation voltage application periods included in a period other than a period in which the video signal voltage is applied. The operation of the gate driver circuit 50 will be described in detail below.

(Configuration of Pixel)

Next, the pixel 20 of the display device 1 according to the embodiment will be described with reference to the drawings.

Figure 2:
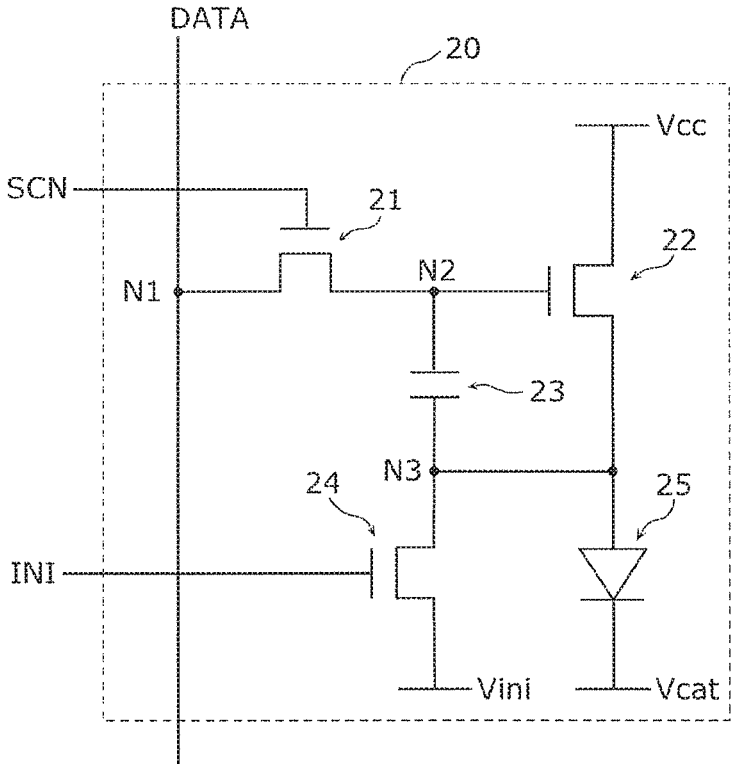
FIG. 2 is a circuit diagram illustrating an exemplary circuit configuration of a pixel according to the embodiment.

FIG. 2 is a circuit diagram illustrating an exemplary circuit configuration of the pixel 20 according to the embodiment.

As illustrated by FIG. 2, the pixel 20 includes a scan line SCN, a data line DATA, an initialization control line INI, a selection transistor 21, a drive transistor 22, a capacitance element 23, an initialization transistor 24, and an organic EL element 25.

The scan line SCN is connected to the gate driver circuit 50 and the gate terminal of the selection transistor 21. The gate driver circuit 50 inputs to the scan line SCN a signal for controlling conduction and non-conduction of the selection transistor 21.

The data line DATA is connected to the data line driver circuit 40 and the source terminal of the selection transistor 21. The data line driver circuit 40 applies to the data line DATA a video signal voltage which is a luminance signal, and a compensation voltage for compensating a threshold voltage of the drive transistor 22.

The initialization control line INI is connected to the gate driver circuit 50 and the gate terminal of the initialization transistor 24. The gate driver circuit 50 inputs to the initialization control line INI a signal for controlling conduction and non-conduction of the initialization transistor 24.

The selection transistor 21 has the gate terminal connected to the scan line SCN, and controls a timing for supplying the video signal voltage and the compensation voltage of the data line DATA to the gate terminal of the drive transistor 22. In the embodiment, the selection transistor 21 includes a TFT. The selection transistor 21 has the source terminal connected to the data line DATA at a node N1, and the drain terminal connected to the gate terminal of the drive transistor 22 and one of the electrodes of the capacitance element 23 at a node N2.

The drive transistor 22 controls a current flowing through the organic EL element 25. In the embodiment, the drive transistor 22 includes a TFT. The drive transistor 22 has the gate terminal connected to the data line DATA via the selection transistor 21 at the node N1, the source terminal connected to the anode terminal of the organic EL element 25 (i.e., node N3), and the drain terminal connected to an anode power line Vcc. With this, the drive transistor 22 converts the video signal voltage supplied to the gate terminal into a signal current corresponding to the video signal voltage, and supplies the converted signal current to the organic EL element 25.

The organic EL element 25 serves as a light-emitting element. The organic EL element 25 has a cathode terminal connected to a cathode power line Vcat. The organic EL element 25 has the anode terminal connected to the source terminal of the drive transistor 22 the other of the electrodes of the capacitance element 23, and one of the source terminal and the drain terminal of the initialization transistor 24 at the node N3.

The initialization transistor 24 is a switch element which switches between conduction and non-conduction between the node N3 and an initialization power line Vini. In the embodiment, the initialization transistor 24 includes a TFT. The initialization transistor 24 has the gate terminal connected to the initialization control line INI, one of the source terminal and the drain terminal connected to the node N3, and the other of the source terminal and the drain terminal connected to the initialization power line Vini.

The capacitance element 23 is a capacitor for maintaining a gate voltage. The capacitance element 23 has one of the electrodes connected to the node N2, and the other of the electrodes connected to the node N3. For example, after the selection transistor 21 is turned off, the capacitance element 23 is capable of maintaining a gate voltage of the drive transistor 22 immediately before the selection transistor 21 is turned off, and continuously causing the drive transistor 22 to supply a drive current to the organic EL element 25.

It is to be noted that although not illustrated by FIGS. 1 and 2, the anode power line Vcc, the initialization power line Vini, and the cathode power line Vcat are connected to the power supply unit 3, and voltage is applied to the anode power line Vcc, the initialization power line Vini, and the cathode power line Vcat.

A data voltage supplied from the data line driver circuit 40 is applied to the gate terminal of the drive transistor 22 via the selection transistor 21. The drive transistor 22 passes a current corresponding to the data voltage between the source terminal and the drain terminal. The current flowing through the organic EL element 25 causes the organic EL element 25 to emit light at luminance corresponding to the current.

It is to be noted that any circuit element, any line, etc. may be inserted in a path connecting each circuit element in the circuit configuration of the pixel 20 illustrated by FIG. 2.

(Operation of Display Device)

Next, simplified operations of the display device 1 according to the embodiment will be described with reference to the drawings.

Figure 3:
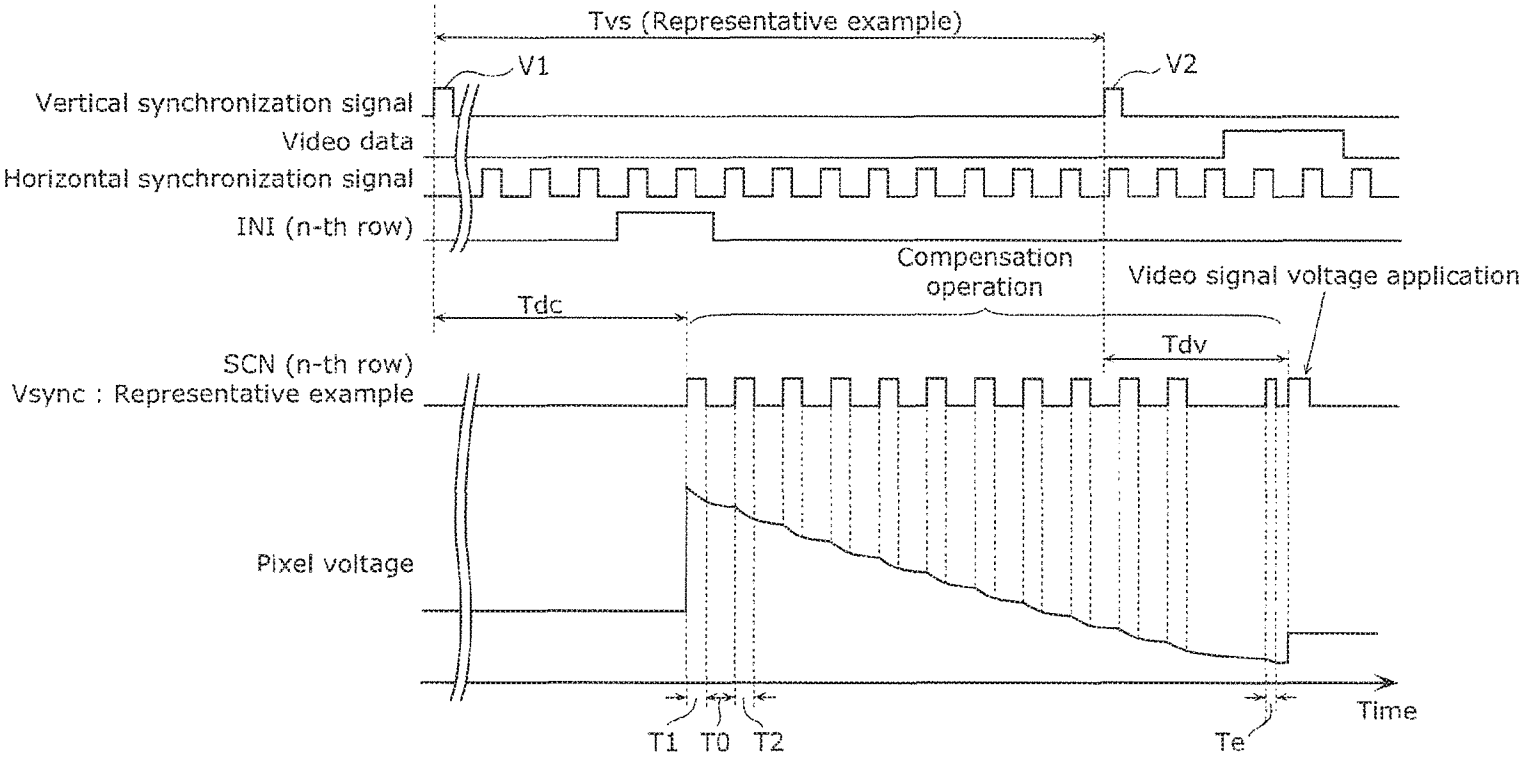
FIG. 3 is a timing diagram illustrating simplified operations of the display device according to the embodiment.

FIG. 3 is a timing diagram illustrating simplified operations of the display device 1 according to the embodiment. FIG. 3 shows a vertical synchronization signal (Vsync), a video signal, and a horizontal synchronization signal which are to be inputted to the control circuit 60, a signal to be inputted to the initialization control line INI, and a signal to be inputted to a scan line SCN of an n-th row. In addition, FIG. 3 shows a simplified waveform of a pixel voltage. Here, the pixel voltage is a voltage applied between the gate terminal and the source terminal of the drive transistor 22.

As illustrated by FIG. 1, the control circuit 60 receives a video signal including a vertical synchronization signal and a horizontal synchronization signal. The control circuit 60 inputs a control signal to each of the gate driver circuit 50 and the data line driver circuit 40 based on the video signal.

As many horizontal synchronization signals as the number of rows of the pixels 20 arranged in the matrix are inputted to the control circuit 60, and the control circuit 60 outputs a control signal to the gate driver circuit 50 based on the horizontal synchronization signals etc. The gate driver circuit 50 inputs a signal to the scan line SCN based on the control signal inputted from the control circuit 60. With this, for example, in addition to a horizontal synchronization signal corresponding to the n-th row of the display unit 2, a high-level signal is inputted from the scan line SCN to the gate terminal of the selection transistor 21 in the pixel 20 disposed in the n-th row. Consequently, conduction is made between the drain terminal and the source terminal of the selection transistor 21. At this time a video signal voltage corresponding to video data is inputted to the data line DATA, and thus a voltage corresponding to the video signal voltage is applied to the gate terminal of the drive transistor 22. This causes the organic EL element 25 of the pixel 20 in the n-th row to emit light at luminance corresponding to the video data. Likewise, a video signal voltage corresponding to video data is applied to the pixels 20 in each row for every horizontal scan period 1H corresponding to an interval between horizontal synchronization signals.

In the embodiment, as illustrated by FIG. 3, a compensation operation for compensating a threshold voltage of the drive transistor 22 of the pixel 22 is performed before a video signal voltage corresponding to video data is applied to the drive transistor 22. In other words, a voltage substantially equal to the threshold voltage of the drive transistor 22 is applied between the gate terminal and the source terminal of the drive transistor 22 immediately before the video signal voltage is applied to the drive transistor 22. This reduces a variation (shift) in the threshold voltage of the drive transistor 22 and degradation of display quality of the display device 1 which results from differences in threshold voltages of the drive transistors 22 among the pixels 20.

Specifically, the gate driver circuit 50 applies to each of the pixels 20 the compensation voltage for compensating the threshold voltage of the drive transistor 22 in each of compensation voltage application periods included in a period other than a period in which the video signal voltage is applied. In the embodiment, as illustrated by FIG. 3, the data line driver circuit 40 applies to the data line DATA a voltage corresponding to the compensation voltage before the video data is inputted to the pixel 20. In addition, the gate driver circuit 50 inputs a high-level signal to the scan line SCN in a compensation voltage application period. With this, the compensation voltage is applied to the gate terminal of the drive transistor 22 in the compensation voltage application period.

In the embodiment, the compensation voltage is applied to the gate terminal of the drive transistor 22 using the data line DATA as described above. A configuration for applying a compensation voltage using the data line DATA will be described with reference to the drawings.

Figure 4:
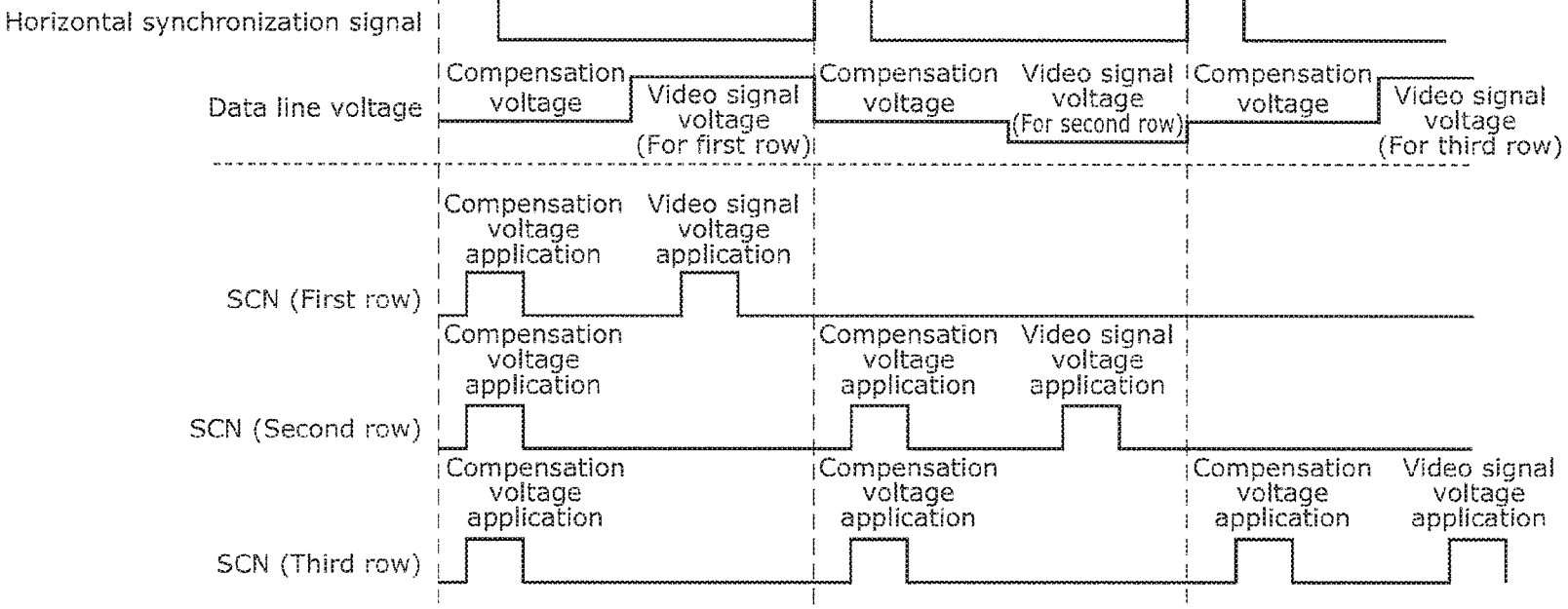
FIG. 4 is a timing diagram illustrating a relationship between a voltage applied to a data line and signals inputted to a scan line according to the embodiment.

FIG. 4 is a timing diagram illustrating a relationship between a voltage applied to the data line DATA and signals inputted to the scan line SCN according to the embodiment.

As illustrated by FIG. 4, a horizontal scan period includes a period in which a compensation voltage is applied to the data line DATA and a period in which a video signal voltage is applied to the data line DATA. A signal pulse for forming a compensation voltage application period is inputted to the scan line SCN of a pixel row for which a compensation operation is performed. In addition, a signal pulse for compensation voltage application and a signal pulse for video signal voltage application are inputted to a pixel row to which a video signal voltage is applied, in the horizontal scan period. For example, the signal pulse for compensation voltage application and the signal pulse for video signal voltage application are applied to the first pixel row, in a horizontal scan period H1 in which only the signal for compensation voltage application is inputted to the second pixel row in FIG. 4. For this reason, this horizontal scan period includes a period in which a compensation voltage is applied to the data line DATA and a period in which a video signal voltage to be applied to the first pixel row is applied.

Likewise, the signal for video signal voltage application is applied to the second pixel row in a horizontal scan period H2 illustrated by FIG. 4, and the signal for video signal voltage application is applied to the third pixel row in a horizontal scan period H3 illustrated by FIG. 4.

As just described, the compensation voltage and the video signal voltage are sequentially applied to the data line DATA in each of the horizontal scan periods. Accordingly, the compensation voltage cannot be applied to the data line DATA in a period in which the video signal voltage is applied to a row other than the n-th row illustrated by FIG. 3 using the data line DATA. In view of this, as illustrated by FIG. 4, the compensation voltage is applied in a period in which the video signal voltage is not applied to the data line DATA and which is included in the horizontal scan period. For this reason, in the embodiment, the compensation voltage is applied in each of the compensation voltage application periods.

In the embodiment, as illustrated by FIG. 3, a high-level signal is inputted to the initialization control line INI of the n-th row before the start of the compensation operation. Consequently, conduction is made between the source terminal and the drain terminal of the initialization transistor 24, and a voltage of the initialization power line Vini is applied to the node N3. The voltage of the initialization power line Vini is set to be −2 V, for example.

As above, the compensation voltage is applied to the gate terminal of the drive transistor 22 with the voltage of the initialization power line Vini applied to the node N3, that is, the source terminal of the drive transistor 22. The compensation voltage is set to be +4 V, for example. As a result, the voltage of 6 V is applied between the gate terminal (node N2) and the source terminal (node N3) of the drive transistor 22 at the start of the first compensation voltage application period T1 illustrated by FIG. 3. In short, the pixel voltage illustrated by FIG. 3 is 6 V. It is to be noted that the threshold voltage of the drive transistor 22 is assumed to be approximately 2 V, for example.

Here, for example, the positive voltage of approximately 15 V is applied to the anode power line Vcc, and the voltage of 0 V is applied to the cathode power line Vcat (i.e., grounded). For this reason, the voltage of 6V higher than the threshold voltage is applied between the gate terminal and the source terminal of the drive transistor 22 to pass a current from the drain terminal of the drive transistor 22 to the source terminal of the same in the first compensation voltage application period T1. With this, parasitic capacitance of the organic EL element 25 is charged, and an electric potential of the source terminal (node N3) of the drive transistor 22 rises. Accordingly, as illustrated by FIG. 3, a voltage between the gate terminal and the source terminal of the drive transistor 22, that is, the pixel voltage drops in the first compensation voltage application period T1.

Next, when the first compensation voltage application period T1 is ended by changing, from a high level to a low level, a signal to be inputted to the scan line SCN from the gate driver circuit 50, the drop in pixel voltage slackens. In other words, as illustrated by FIG. 3, the pixel voltage drops more gently in a period T0 between the first compensation voltage application period T1 and the next compensation voltage application period T2 than in the first compensation voltage application period T1.

Next, a signal to be inputted to the scan line SCN from the gate driver circuit 50 is changed again from the low level to the high level. With this, when the second compensation voltage application period T2 is started, the compensation voltage of +4 V is applied again to the gate terminal of the drive transistor 22. Moreover, the initialization transistor 24 is not conducted in any compensation voltage application period after the second compensation voltage application period. For this reason, a potential of the source terminal of the drive transistor 22 is higher than −2 V. Accordingly, the pixel voltage at the start of the second compensation voltage application period T2 is lower than the pixel voltage (6 V) at the start of the first compensation voltage application period T1, and thus a current flowing from the drain terminal of the drive transistor 22 to the source terminal of the same is smaller than a current in the first compensation voltage application period T1. Furthermore, the drop in pixel voltage is gentler in the second compensation voltage application period T2 than in the first compensation voltage application period T1. As illustrated by FIG. 3, the pixel voltage drops in the same manner in any compensation voltage application period after the second compensation voltage application period T2, and gradually approaches the threshold voltage.

In the above compensation operation, a predetermined number of compensation voltage application periods in a series of compensation operations is determined by properly setting a time Tdc, illustrated by FIG. 3, from when the gate driver circuit 50 receives a vertical synchronization signal V1 to when the compensation operation is started. Here, the series of the compensation operations denotes a compensation operation performed every time a video signal voltage is applied to the gate terminal of the drive transistor 22. Stated differently, the number of the compensation voltage application periods in the series of the compensation operations denotes the number of compensation voltage application periods per time interval between vertical synchronization signals. In the embodiment, the number of the compensation voltage application periods is approximately from 20 to 30, for example. It is to be noted that in FIG. 3 the timing diagram is simplified by showing a fewer number of the compensation voltage application periods than in reality.

On the other hand, a timing for applying a video signal voltage to the gate terminal of the drive transistor 22 is determined with reference to a point in time when the gate driver circuit 50 receives a vertical synchronization signal V2 subsequent to the vertical synchronization signal V1. In a word, as illustrated by FIG. 3, a video signal voltage is applied to the gate terminal of the drive transistor 22 after a time Tdv has passed since the gate driver circuit 50 received the vertical synchronization signal V2. As seen above, the vertical synchronization signal V1 to be a reference for determining a timing for starting a compensation operation is different from the vertical synchronization signal V2 to be a reference for determining a timing for applying a video signal voltage. In addition, an interval at which the gate driver circuit 50 receives a vertical synchronization signal is not constant. Specifically, the interval at which the gate driver circuit 50 receives the vertical synchronization signal may shift from a representative interval Tvs (i.e., average interval) by approximately the horizontal scan period 1H. Accordingly, a time from the start of the compensation operation to the application of the video signal voltage may vary by approximately the horizontal an period 1H.

Here, even when the time from the start of the compensation operation to the application of the video signal voltage varies, it may be presumed that a degree of compensation for a threshold voltage is set to be constant by performing the compensation operation to set the number of the compensation voltage application periods to be constant. As described above, however, in the compensation operation, the pixel voltage drops even in a period in which the compensation voltage is not applied (see period T0 in FIG. 3, for example), and thus the degree of the compensation for the threshold voltage varies depending on the variation in the time from the start of the compensation operation to the application of the video signal voltage.

In view of this, in the embodiment, the control circuit 60 adjusts, among the compensation voltage application periods, a preceding compensation voltage application period Te immediately before the video signal voltage is applied. This reduces the variation in the degree of the compensation for the threshold voltage which results from the variation in the time from the start of the compensation operation to the application of the video signal voltage. Hereinafter, a method for adjusting the preceding compensation voltage application period Te immediately before the video signal voltage is applied will be described with reference to the drawings.

Figure 5:
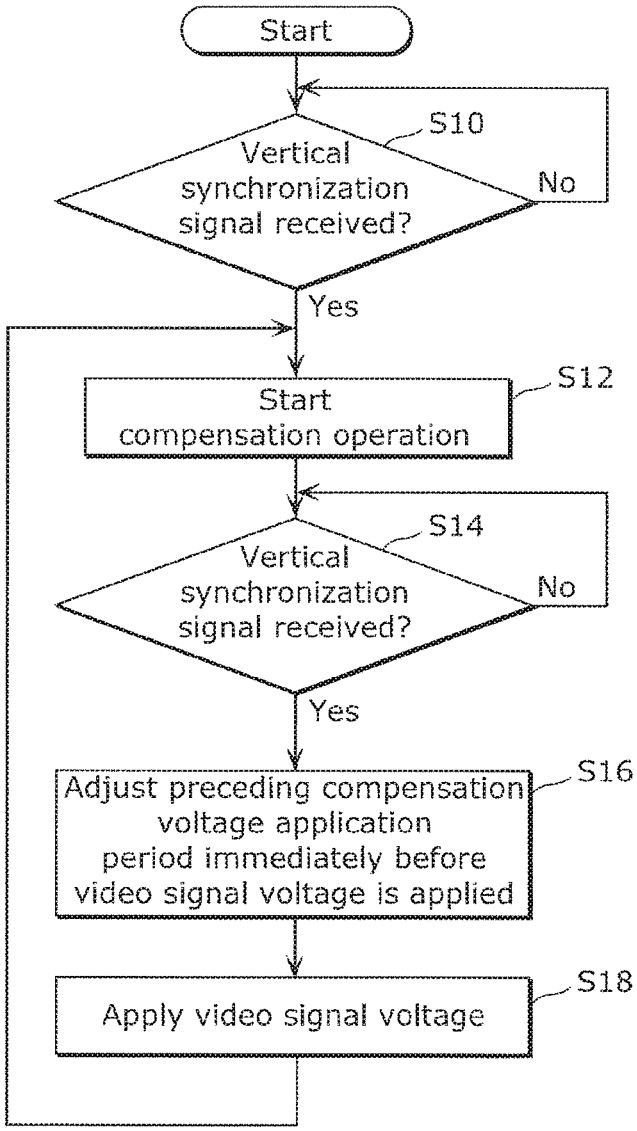
FIG. 5 is a flow chart illustrating a method for controlling the display device according to the embodiment.

FIG. 5 is a flow chart illustrating a method for controlling the display device 1 according to the embodiment.

Figure 6:
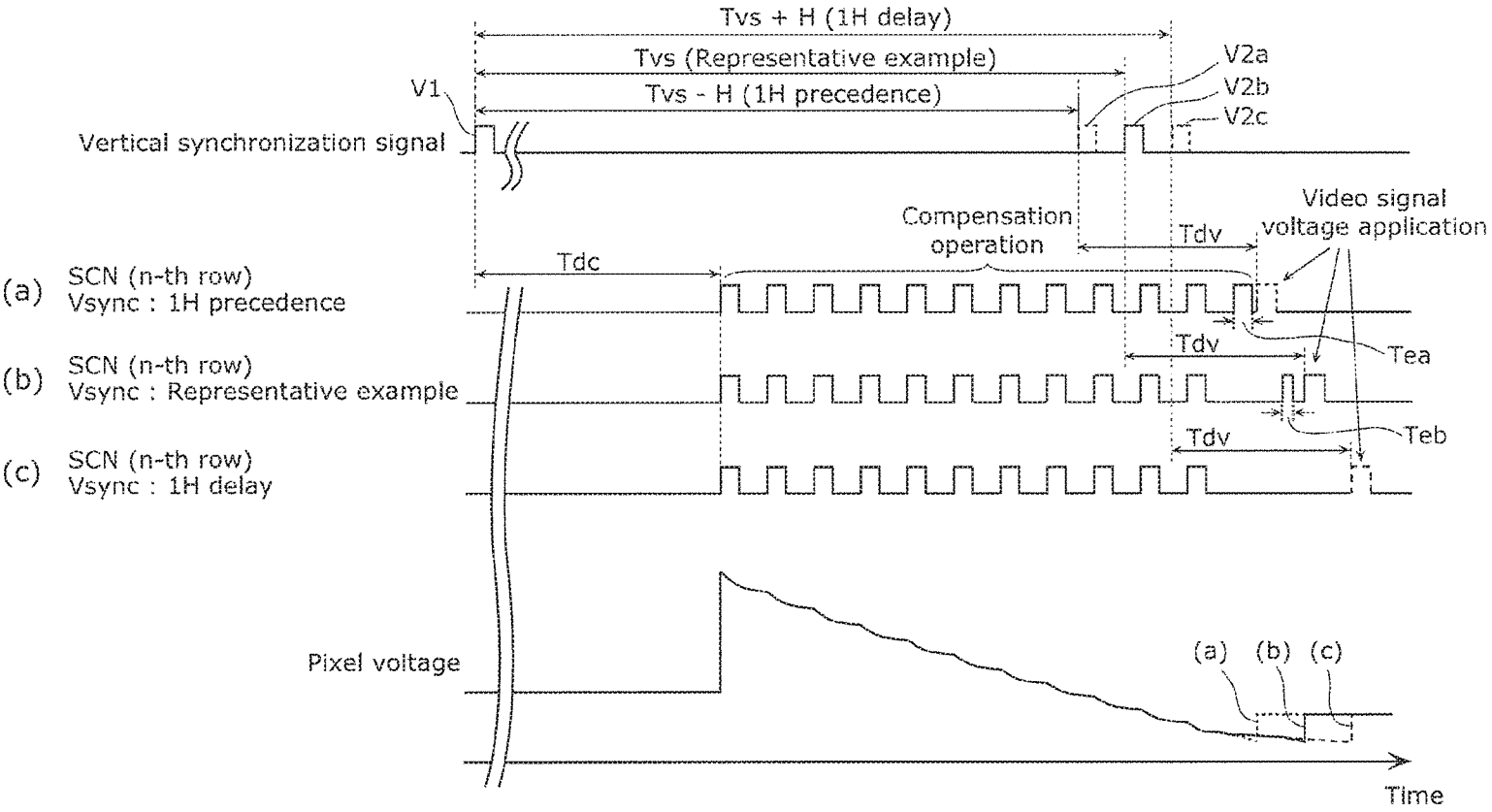
FIG. 6 is a diagram illustrating a compensation operation of the display device according to the embodiment.

FIG. 6 is a diagram illustrating a compensation operation of the display device 1 according to the embodiment. FIG. 6 illustrates three timing diagrams (a), (b), and (c) for compensation operation each of which corresponds to a different one of three timing examples of a vertical synchronization signal. In addition, FIG. 6 illustrates three simplified waveforms of a pixel voltage each of which corresponds to a different one of the three timing examples of the vertical synchronization signal.

As illustrated by FIG. 5, in the display device 1 according to the embodiment, the control circuit 60 first determines whether a vertical synchronization signal is received (S10). When the vertical synchronization signal is not received (No in S10), the control circuit 60 repeats step S10 until the vertical synchronization signal is received.

When a vertical synchronization signal V1 illustrated by FIG. 6 is received (Yes in S10), the control circuit 60 outputs a control signal to the gate driver circuit 50 to start a compensation operation after a predetermined time Tdc has passed since the vertical synchronization signal was received (S12). In other words, based on the control signal from the control circuit 60, the gate driver circuit 50 applies to each of the pixels 20 a compensation voltage for compensating a threshold voltage of the drive transistor 22 in each of compensation voltage application periods included in a period other than a period in which a video signal voltage is applied.

Specifically, the gate driver circuit 50 inputs a high-level signal to the initialization control INI to conduct between the drain terminal and the source terminal of the initialization transistor 24, and to apply to the source terminal of the drive transistor 22 a voltage of the initialization power line Vini. Moreover, the gate driver circuit 50 inputs the high-level signal to the scan line SCN with the compensation voltage applied to the data line DATA, to conduct between the drain terminal and the source terminal of the selection transistor 21, and to apply the compensation voltage to the gate terminal of the drive transistor 22. The gate driver circuit 50 repeats, a predetermined number of times, the application of the compensation voltage to the gate terminal of the drive transistor 22 in a predetermined compensation voltage application period. As illustrated by FIG. 6, this allows a pixel voltage to gradually approach the threshold voltage of the drive transistor 22.

After starting the aforementioned compensation operation, the control circuit 60 determines whether a vertical synchronization signal is received (S14). When the vertical synchronization signal is not received (No in S14), the control circuit 64 repeats step S14 until the vertical synchronization signal is received.

When a vertical synchronization signal V2*a*, V2*b*, or V2*c* illustrated by FIG. 6 is received (Yes in S14), the control circuit 60 adjusts the length of a preceding compensation voltage application period immediately before a video signal voltage is applied (S16).

For example, a case will be described where the vertical synchronization signal V2*a* illustrated by FIG. 6 is received. In this case, an interval between the vertical synchronization signal V1 and the vertical synchronization signal V2*a* received subsequent to the vertical synchronization signal V1 is shorter than the representative (average) interval Tvs by the horizontal scan period 1H. In other words, the vertical synchronization signal V2*a* is precedentially received by the horizontal scan period 1H as compared to the vertical synchronization signal V2*b*, an exemplary vertical synchronization signal received with a representative timing. As illustrated by the timing diagram (a) in FIG. 6, in such a case, an entire period for compensation operation is shorter than in a case where the vertical synchronization signal V2*b* is received. For this reason, assuming that the length of the compensation voltage application period is not adjusted, a degree of compensation for a threshold voltage is smaller than in the case where the vertical synchronization signal V2*b* is received.

In view of this, in this case, a preceding compensation voltage application period Tea immediately before the video signal voltage is applied to the gate terminal of the drive transistor 22 is adjusted to be longer than a compensation voltage application period Teb in the case where the vertical synchronization signal V2*b* is received. A drop rate of a pixel voltage per unit time is greater in a compensation voltage application period than in a period in which a compensation voltage is not applied, and thus extending the compensation voltage application period makes it possible to increase the degree of the compensation for the threshold voltage. This reduces a difference between the degree of the compensation for the threshold voltage in the case where the vertical synchronization signal V2*a* is received, and the degree of the compensation for the threshold voltage in the case where the vertical synchronization signal V2*b* is received.

On the other hand, in the case where the vertical synchronization signal V2*c* illustrated by FIG. 6 is received, an interval between the vertical synchronization signal V1 and the vertical synchronization signal V2*c* received subsequent to the vertical synchronization signal V1 is longer than the representative interval Tvs by the horizontal scan period 1H. In other words, the vertical synchronization signal V2*c* is belatedly received by the horizontal scan period 1H as compared to the vertical synchronization signal V2*b*, an exemplary vertical synchronization signal received with a representative timing. As illustrated by the timing diagram (c) in FIG. 6, in such a case, an entire period for compensation operation is longer than in the case where the vertical synchronization signal V2*b* is received. For this reason, assuming that the length of the compensation voltage application period is not adjusted, a degree of compensation for a threshold voltage is greater than in the case where the vertical synchronization signal V2*b* is received.

In view of this, in this case, a preceding compensation voltage application period immediately before the video signal voltage is applied to the gate terminal of the drive transistor 22 is adjusted to be shorter than the compensation voltage application period Teb in the case where the vertical synchronization signal V2*b* is received. In the embodiment, the preceding compensation voltage application period is zero. As seen above, in the embodiment, one aspect of shortening the preceding compensation voltage application period includes setting the preceding compensation voltage application period to be zero, that is, decreasing the number of the compensation voltage application periods. The drop rate of the pixel voltage per unit time is greater in the compensation voltage application period than in the period in which the compensation voltage is not applied, and thus shortening the compensation voltage application period makes it possible to decrease the degree of the compensation for the threshold voltage. This reduces a difference between the degree of the compensation for the threshold voltage in the case where the vertical synchronization signal V2*c* is received, and the degree of the compensation for the threshold voltage in the case where the vertical synchronization signal V2*b* is received.

As mentioned above, the display device 1 according to the embodiment adjusts the length of the preceding compensation voltage application period immediately before the video signal voltage is applied to the gate terminal of the drive transistor 22. More specifically, the control circuit 60 adjusts the length of the preceding compensation voltage application period, based on the timing of the vertical synchronization signal. In the embodiment, the control circuit 60 adjusts the preceding compensation voltage application period to be longer as an interval between two vertical synchronization signals immediately before the video signal voltage is applied is shorter. As shown by the waveform of the pixel voltage in FIG. 6, this makes it possible to reduce the variation in the pixel voltage when the video signal voltage is inputted, that is, the variation in the degree of the compensation for the threshold voltage. Accordingly, it is possible to reduce the variation in the luminance of the pixel 20 caused by the degree of the compensation for the threshold voltage varying.

It is to be noted that the gate driver circuit 50 may include, as a specific configuration for adjusting only the preceding compensation voltage application period immediately before the video signal voltage is applied as described above, a signal pulse generation circuit for creating the preceding compensation voltage application period for the gate driver circuit 50. More specifically, the gate driver circuit 50 includes, for example, a shift register for creating the preceding compensation voltage application period in addition to a shift register for creating a compensation voltage application period other than the preceding compensation voltage application period. This makes it possible to freely adjust the length of any compensation voltage application period other than the preceding compensation voltage application period.

Moreover, in the example illustrated by FIG. 6, a timing of the preceding compensation voltage application period immediately before the video signal voltage is applied differs between the case where the vertical synchronization signal V2*a* is received and the case where the vertical synchronization signal V2*b* is received. To put it differently, the preceding compensation voltage application period immediately before the video signal voltage is applied is provided later by the horizontal scan period 1H in the case where the vertical synchronization signal V2*b* is received than in the case where the vertical synchronization signal V2*a* is received. However, the method for controlling the display device 1 according to the embodiment is not limited to this. For example, a timing of the preceding compensation voltage application period immediately before the video signal voltage is applied may not differ between the case where the vertical synchronization signal V2*a* is received and the case where the vertical synchronization signal V2*b* is received.

After the compensation operation is performed as described above, the video signal voltage is applied to the gate terminal of the drive transistor 22 (S18). This causes the organic EL element 25 of the pixel 20 to emit light at luminance corresponding to the video signal data. In the embodiment, as shown by the graph of the pixel voltage in FIG. 3, the variation in the pixel voltage after the video signal voltage is applied, which results from the variation in the interval between the vertical synchronization signals, is reduced.

Subsequently, the flow goes back to the above-described step S12, and a compensation operation is started based on a timing for receiving the vertical synchronization signal V2*a*, V2*b*, or V2*c*. The same operation is repeated after this.

As described above, the method for controlling the display device 1 according to the embodiment makes it possible to reduce the variation in the degree of the compensation for the threshold voltage, which results from the variation in the interval between the vertical synchronization signals.

Comparative Example

Next, in order to explain the advantageous effects of the display device 1 according to the embodiment, operations of a display device according to a comparative example will be described with reference to the drawings. The display device according to the comparative example differs in control method from the display device 1 according to the embodiment but has the same configuration as the display device 1 according to the embodiment.

Figure 7:
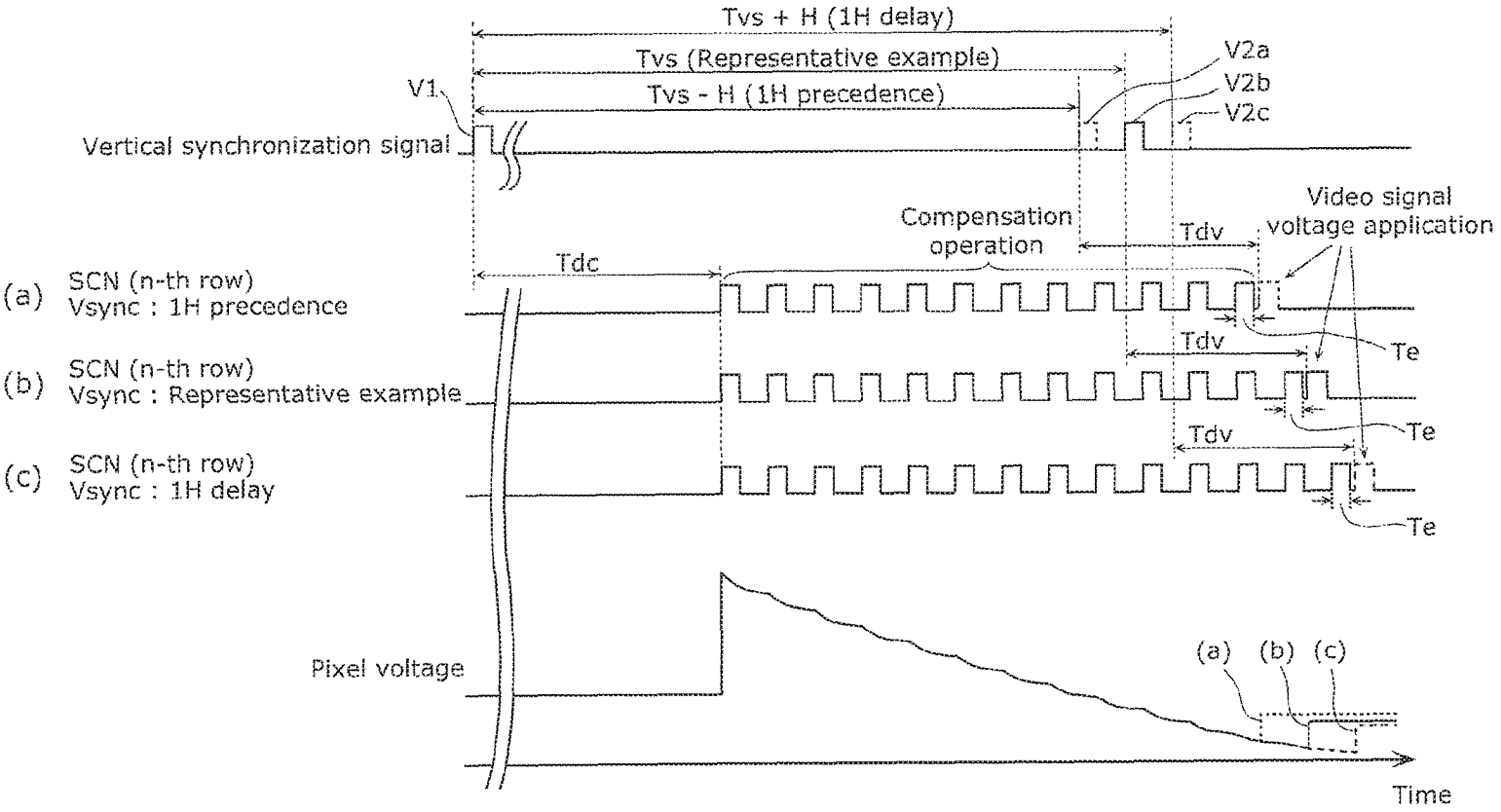
FIG. 7 is a diagram illustrating a compensation operation of the display device according to a comparative example.

FIG. 7 is a diagram illustrating a compensation operation of the display device according to the comparative example. FIG. 7 illustrates three timing diagrams (a), (b), and (c) for compensation operation each of which corresponds to a different one of three timing examples of a vertical synchronization signal. In addition, FIG. 7 illustrates three simplified waveforms (a), (b), and (c) of a pixel voltage each of which corresponds to a different one of the three timing examples of the vertical synchronization signal.

The display device according to the comparative example illustrated by FIG. 7 differs, from the display device 1 according to the embodiment, in that the preceding compensation voltage application period Te immediately before the video signal voltage is applied to the gate terminal of the drive transistor is not adjusted depending on a timing of a vertical synchronization signal. In addition, with the display device according to the comparative example, the number of compensation voltage application periods may vary depending on the timing of the vertical synchronization signal. In other words, when an interval between the vertical synchronization signal V1 and the vertical synchronization signal received subsequent to the vertical synchronization signal V1 becomes shorter, the number of the compensation voltage application periods is decreased. For example, as illustrated by the timing diagram (a) in FIG. 7, the number of the compensation voltage application periods is fewer by one in a case where the vertical synchronization signal V2*a* is received subsequent to the vertical synchronization signal V1 than in a case where the vertical synchronization signal V2*b* is received (see the timing diagram (b)). Conversely, as illustrated by the timing diagram (c) in FIG. 7, the number of the compensation voltage application periods is greater by one in a case where the vertical synchronization signal V2*c* is received subsequent to the vertical synchronization signal V1 than in the case where the vertical synchronization signal V2*b* is received (see the timing diagram (b)).

Accordingly, with the display device according to the comparative example, as illustrated by temporal waveforms (a), (b), and (c) of a pixel voltage in FIG. 7, the pixel voltage at a time when a video signal voltage is applied varies depending on an interval between vertical synchronization signals. In short, a degree of compensation for a threshold voltage of the drive transistor varies depending on the interval between the vertical synchronization signals. Along with this, luminance of the organic EL element varies.

It is to be noted that although the comparative example shows the case where the number of the compensation voltage application periods varies depending on the variation in the interval between the vertical synchronization signals, even in a case where the number of the compensation voltage application periods does not vary, the degree of the compensation for the threshold voltage of the drive transistor may vary depending on the variation in the interval between the vertical synchronization signals. In other words, even if the number of the compensation voltage application periods does not vary, the degree of the compensation for the threshold voltage may vary by the length of an entire period of a compensation operation varying. As mentioned above, this is caused by the pixel voltage in a period of a compensation operation dropping in a period in which the compensation voltage is not applied.

As above, in the display device according to the comparative example which does not use the method for controlling the display device 1 according to the embodiment, as shown by the temporal waveforms of the pixel voltage in FIG. 7, the degree of the compensation for the threshold voltage may vary due to the variation in the interval between the vertical synchronization signals. By contrast, the display device 1 according to the embodiment makes it possible to reduce the variation in the degree of the compensation for the threshold voltage, which results from the variation in the interval between the vertical synchronization signals.

Summary

As above, the display device 1 according to the embodiment includes pixels 20 each of which includes the organic EL element 25 and the drive transistor 22 which controls a current flowing through the organic EL element 25. Moreover, the display device 1 further includes the gate driver circuit 50 which applies to each of the pixels 20 the compensation voltage for compensating the threshold voltage of the drive transistor 22 in each of the compensation voltage application periods included in the period other than the period in which the video signal voltage is applied. Furthermore, the display device 1 further includes the control circuit 60 which controls the gate driver circuit 50. The control circuit 60 adjusts the length of, among the compensation voltage application periods, the preceding compensation voltage application period immediately before the video signal voltage is applied.

As just described, the display device 1 makes it possible to reduce the variation in the degree of the compensation for the threshold voltage in the compensation operation, by appropriately adjusting the length of the preceding compensation voltage application period immediately before the video signal voltage is applied.

In addition, in the display device 1, the control circuit 60 adjusts the length of the preceding compensation voltage application period, based on the timing of the vertical synchronization signal.

Accordingly, even in the case where the interval between the vertical synchronization signals varies, it is possible to reduce the variation in the degree of the compensation for the threshold voltage in the compensation operation, by appropriately adjusting the length of the preceding compensation voltage application period based on the timing of the vertical synchronization signal.

Moreover, in the display device 1, the control circuit 60 makes the preceding compensation voltage application period longer as the interval between the two vertical synchronization signals immediately before the video signal voltage is applied is shorter.

With this, it is possible to reduce the variation in the degree of the compensation for the threshold voltage, which results from the variation in the interval between the vertical synchronization signals.

Furthermore, the display device 1 applies the compensation voltage to the pixels 20 via the data lines DATA for applying the video signal voltage to the pixels 20.

With this, it is possible to apply the compensation voltage to the pixels 20 without adding a line for applying the compensation voltage. In short, it is possible to apply the compensation voltage to the pixels 20 without complicating the configuration of the display device 1.

Other Embodiments

Although the display device and the method for controlling the display device according to the present disclosure have been described above based on the embodiment, the display device and the method for controlling the display device according to the present disclosure is not limited to the embodiment. Other embodiments implemented by combining arbitrary structural components in the embodiment, variations obtained by executing various medications on the embodiment that can be conceived by a person with an ordinary skill in the art without departing from the essence of the present disclosure, and various devices incorporating the display device according to the embodiment are included in the present disclosure.

For example, although only one preceding compensation voltage application period immediately before the video signal voltage is applied is adjusted in the aforementioned embodiment, an adjustment target may not be the only one compensation voltage application period. The lengths of two or more compensation voltage application periods may be adjusted.

Moreover, although the compensation voltage is applied to each pixel 20 via the data line DATA in the aforementioned embodiment, the compensation voltage may be applied via another path.

Furthermore, although the aforementioned embodiment shows that the preceding compensation voltage application period immediately before the video signal voltage is applied is adjusted to be shorter than the other compensation voltage application periods, the preceding compensation voltage application period may be adjusted to be longer than the other compensation voltage application periods. In a case where the compensation voltage application period is adjusted to be shorter, the adjustment is made more difficult and the accuracy of the adjustment is decreased further as the compensation voltage application period approaches zero, but in a case where the compensation voltage application period is adjusted to be longer, the adjustment is easy and an decrease in the accuracy of the adjustment can be reduced.

Moreover, although the aforementioned embodiment shows the example where the organic EL element is used as the light-emitting element, another current-driven EL element may be used.

Furthermore, although the aforementioned embodiment shows that an n-type TFT is used as the drive transistor 22, a p-type TFT may be used as the drive transistor 22 and other circuit configurations may be changed accordingly.

Figure 8:
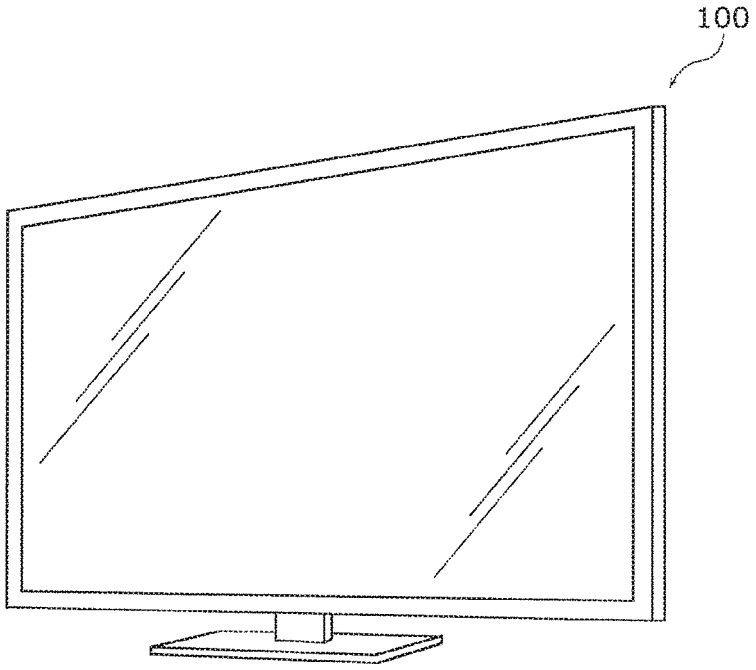
FIG. 8 is a thin flat-panel TV which includes the display device according to the embodiment.

Moreover, for example, the display device 1 according to the embodiment is included in a thin flat-panel TV 100 as illustrated by FIG. 8. The display device 1 according to the embodiment makes it possible to achieve a thin flat-panel TV for which a variation in luminance is reduced and which has high display quality.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is useful for organic EL flat panel displays, and is suitable for use as a display which is required to have high display quality.

The invention claimed is:

1. A display device, comprising:

a plurality of pixels, each of which includes an electroluminescent (EL) element and a drive transistor that controls a current flowing through the EL element;

a gate driver circuit that applies, to each of the plurality of pixels, a compensation voltage enable pulse for compensating a threshold voltage of the drive transistor, in each of compensation voltage application periods included in a period other than a period in which a video signal voltage is applied; and a control circuit that controls the gate driver circuit, wherein the control circuit adjusts a length of, among the compensation voltage application periods, a preceding compensation voltage application period immediately before the video signal voltage is applied, wherein the control circuit adjusts the length of the preceding compensation voltage application period based on a timing of a vertical synchronization signal, wherein a compensation voltage is applied to a gate terminal of the drive transistor of each of the plurality of pixels a predetermined number of compensation voltage application periods in a predetermined compensation operation period that causes a gradual reduction of a pixel voltage to approach the threshold voltage of the drive transistor, and wherein the predetermined number of compensation application voltage periods is in the range of 20-30.

2. The display device according to claim 1, wherein the control circuit adjusts the preceding compensation voltage application period to be longer as an interval between two vertical synchronization signals immediately before the video signal voltage is applied is shorter.

3. The display device according to claim 1, wherein the compensation voltage is applied to the plurality of pixels via data lines for applying the video signal voltage to the plurality of pixels.

4. A method for controlling a display device, including a plurality of pixels each of which includes an EL element and a drive transistor that controls a current flowing through the EL element, the method comprising:

applying, to each of the plurality of pixels, a compensation voltage for compensating a threshold voltage of the drive transistor, in each of compensation voltage application periods included in a period other than a period in which a video signal voltage is applied;

adjusting a length of, among the compensation voltage application periods, a preceding compensation voltage application period immediately before the video signal voltage is applied;

adjusting the length of the preceding compensation voltage application period based on a timing of a vertical synchronization signal, applying a compensation voltage to a gate terminal of the drive transistor of each of the plurality of pixels a predetermined number of compensation voltage application periods in a predetermined compensation operation period to cause a gradual reduction of a pixel voltage to approach the threshold voltage of the drive transistor, and wherein the predetermined number of compensation application voltage periods is in the range of 20-30.

* * * * *